US005203094A

United States Patent [19]

Freiberg et al.

[11] Patent Number: 5,203,094

[45] Date of Patent: Apr. 20, 1993

[54] TEXTILE DRYING MACHINE HAVING PASS-THROUGH INTAKE CONDUIT FOR ONE DRYING FLUID DISTRIBUTION MEANS

[75] Inventors: Helge Freiberg, Mönchengladbach; Manfred Pabst, Cologne, both of Fed. Rep. of Germany

[73] Assignee: A. Monforts GmbH & Co., Moenchengladbach, Fed. Rep. of Germany

[21] Appl. No.: 746,877

[22] Filed: Aug. 19, 1991

[30] Foreign Application Priority Data

Aug. 17, 1990 [DE] Fed. Rep. of Germany ..... 4026107

[51] Int. Cl.[5] ..... F26B 13/00

[52] U.S. Cl. ..... 34/158; 34/155

[58] Field of Search ..... 34/155, 156, 158

[56] References Cited

U.S. PATENT DOCUMENTS

| | | | |
|---|---|---|---|
| 4,137,649 | 2/1979 | Fleissner | 34/158 |
| 4,320,587 | 3/1982 | Vits | 34/156 |
| 4,425,719 | 1/1984 | Klein et al. | 34/156 |

FOREIGN PATENT DOCUMENTS

| | | |
|---|---|---|
| 497035 | 4/1930 | Fed. Rep. of Germany . |
| 2201731 | 7/1973 | Fed. Rep. of Germany . |
| 1785636 | 11/1973 | Fed. Rep. of Germany . |
| 2908348A1 | 9/1980 | Fed. Rep. of Germany . |
| 2217667 | 9/1982 | Fed. Rep. of Germany . |
| 3308869 | 9/1983 | Fed. Rep. of Germany . |
| 2927974C2 | 8/1985 | Fed. Rep. of Germany . |
| 3627904 | 2/1988 | Fed. Rep. of Germany . |

*Primary Examiner*—Stephen M. Hepperle

*Attorney, Agent, or Firm*—Shefte, Pinckney & Sawyer

[57] ABSTRACT

A textile drying machine includes upper and lower distribution housings for applying streams of drying fluid to a traveling web of textile material from above and below the traveling web. The pair of distribution housings are each mounted to the floor on the same lateral side of the traveling web at a lateral spacing from one another and each provides a distribution opening which extends over the entire extent of the traveling web being treated. Each distribution housing includes an intake conduit for the intake of exhaust drying fluid which has been subjected to a heat exchange operation in which the heat content of the drying fluid is restored. The intake conduit for the respective distribution housing which is laterally outward of the other distribution housing includes an extension portion passing through the laterally inward distribution housing, thereby making possible the space-saving compact arrangement in which both of the distribution housings are mounted on the floor on the same lateral side of the traveling web. According to one aspect of the invention, separate exhaust drying fluid regions are provided for separately guiding the exhaust drying fluid respectively above and below the dedicated one of the distribution housings.

8 Claims, 2 Drawing Sheets

TEXTILE DRYING MACHINE HAVING PASS-THROUGH INTAKE CONDUIT FOR ONE DRYING FLUID DISTRIBUTION MEANS

BACKGROUND OF THE INVENTION

The present invention relates to a textile drying machine having a pass-through intake conduit for one respective drying fluid distribution means and, more particularly, a textile drying machine of the type for applying drying fluid to a traveling web of textile material having an underneath treatment means for applying drying fluid from below the web and an overhead treatment means for applying drying fluid from above the web having an intake conduit passing through a portion of the underneath treatment means.

In one known construction of a textile drying machine such as, for example, a machine commonly referred to as a tenter frame, a web of textile material is advanced horizontally between upper and lower treatment means, each having a distribution housing in which a plurality of jet nozzles mounted for applying a drying fluid such as, for example, heated air, to the traveling web. In addition to ensuring the uniform distribution of the drying fluid onto the traveling web, each of the upper and lower distribution means is provided with an exhaust outlet for exhausting drying fluid which has already contacted the traveling web away from the traveling web to be recirculated through the distribution means. Thus, the upper and lower distribution means of the known textile drying machine continuously recirculate the drying fluid through a continuous loop in which the drying fluid is applied to the traveling web, drawn away from the traveling web through an exhaust outlet and again conducted into the distribution means for reapplication to the traveling web after a heat exchange step or other reconditioning step in which the drying fluid is heated or otherwise reconditioned for re-application to the traveling web.

Each of the upper and lower distribution means extends across the width of the traveling web and extends as well in the direction of advancement of the traveling web to thereby apply drying fluid to the entire respective lengthwise portion of the web traveling through the textile drying machine. Accordingly, the upper and lower distribution means and, in particular, their respective intake components for intaking exhaust drying fluid, must be particularly arranged to avoid interference with one another's operation. Although a number of arrangements have been proposed such as, for example, an arrangement in which all of the components of the upper distribution means are mounted above the traveling web, these proposed solutions still do not optimally minimize the space requirements of the textile drying machine. Additionally, the proposed prior art arrangements of the upper and lower distribution mean do not readily permit independent regulation of the operational parameters of each respective distribution means such as, for example, independent regulation of the pressure and temperature of the drying fluid applied by each respective distribution means.

SUMMARY OF THE INVENTION

The present invention provides a textile drying machine having an intake conduit for one of a pair of treatment means which passes completely laterally through the other of the treatment means to thereby permit a space-saving arrangement in which both treatment means are mounted to the floor on the same lateral side of the web.

Briefly described, the present invention provides a textile drying machine for applying a drying fluid to a traveling web of textile material comprising means for advancing a web of textile material along a generally planar travel path and near side treatment means including near side jet nozzle means for jetting drying fluid onto the web from a near side thereof relative to a transverse axis transverse to the plane of the travel path and a near side housing, the near side housing having a base portion and a distribution portion extending from the base portion in which the near side jet nozzle means is mounted.

The textile drying machine also includes far side treatment means including far side jet nozzle means for jetting drying fluid onto the web from the far side of the web opposite to the near side thereof and a far side housing, the far side housing including a base portion and a distribution portion extending from the base portion in which the far side jet nozzle means is mounted. The base portion of the far side housing extends from the far side of the web to the near side of the web on one lateral side of the web and is laterally outward of the base portion of the near side housing. Additionally, the base portions of the near side housing and the far side housing are substantially co-extensive with one another relative to the travel path.

The textile drying machine also includes a near side exhaust outlet formed in the near side housing for passage therethrough of exhaust drying fluid being drawn away from the web and a far side exhaust outlet formed in the far side housing for passage therethrough of exhaust drying fluid being drawn away from the web. The textile drying machine also includes first intake means for the intake of exhaust drying fluid, the first intake means including a first intake conduit extending into the base portion of the near side treatment means and suction means for drawing exhaust drying fluid into the first intake conduit and second intake means for the intake of exhaust drying fluid, the second intake means including a second intake conduit extending laterally completely through the base portion of the near side housing and into the base portion of the far side housing and suction means for drawing drying fluid into the second intake conduit.

According to one aspect of the present invention, the textile drying machine also includes a first heat exchanger means disposed intermediate the near side exhaust outlet and the first intake conduit relative to the flow of drying fluid therebetween for performing a heat exchange operation on drying fluid after its passage through the near side exhaust outlet and before its intake into the first intake conduit and a second heat exchanger means disposed intermediate the far side exhaust outlet and the second intake conduit relative to the flow of drying fluid therebetween for performing a heat exchange operation on drying fluid after its passage through the far side exhaust outlet and before its intake into the second intake conduit.

According to one feature of the textile drying machine of the present invention, the first and second intake conduits are disposed at generally the same transverse spacing from the plane of the path of the traveling web.

According to another aspect of the present invention, the textile drying machine preferably includes first flow path defining means extending from the distribution portion of the near side housing and forming therewith a first flow path in which the first heat exchanger means is disposed, whereby the drying fluid passing through the near side exhaust outlet is constrained to flow along the first flow path through the first heat exchanger means and thereafter into the first intake conduit. Also, the textile drying machine includes second flow path defining means extending from the distribution portion of the far side housing and forming therewith a second flow path in which the second heat exchanger means is disposed whereby the drying fluid passing through the far side exhaust outlet is constrained to flow through the second heat exchanger means and into the second intake conduit According to yet another aspect of the present invention, the first intake conduit is communicated with the distribution portion of the near side housing and the second intake conduit is communicated with the distribution portion of the far side housing, whereby drying fluid flows through the first intake conduit to the distribution portion of the near side housing for the application of the drying fluid onto the web by the near side jet nozzle means and drying fluid flows through the second intake conduit to the distribution portion of the far side housing for the application of the drying fluid onto the web by the far side jet nozzle means.

DESCRIPTION OF THE PREFERRED EMBODIMENT

Figure 1:
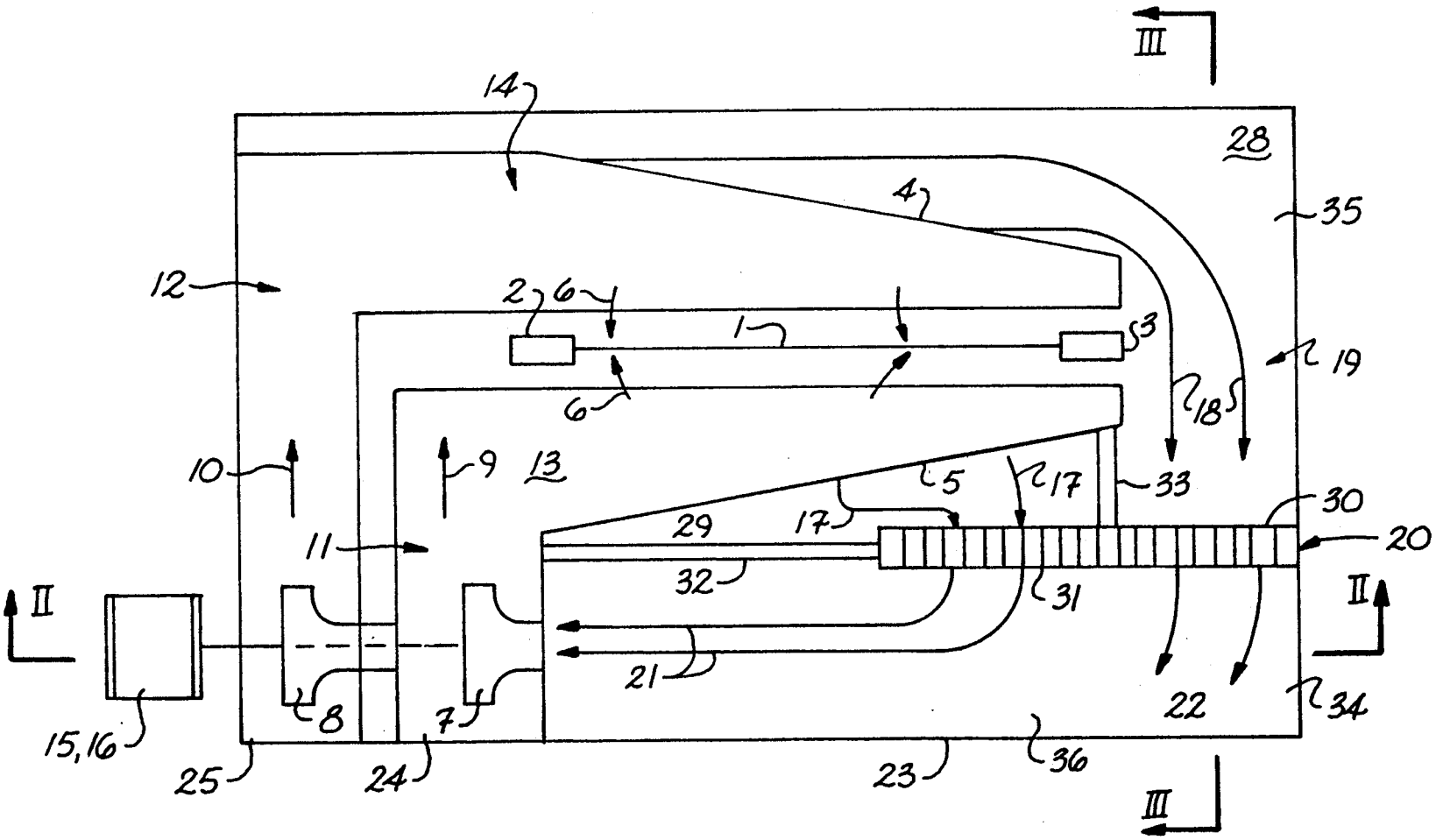
FIG. 1 is a side elevational view, in vertical section, of the preferred embodiment of the textile drying machine of the present invention.
Figure 2:
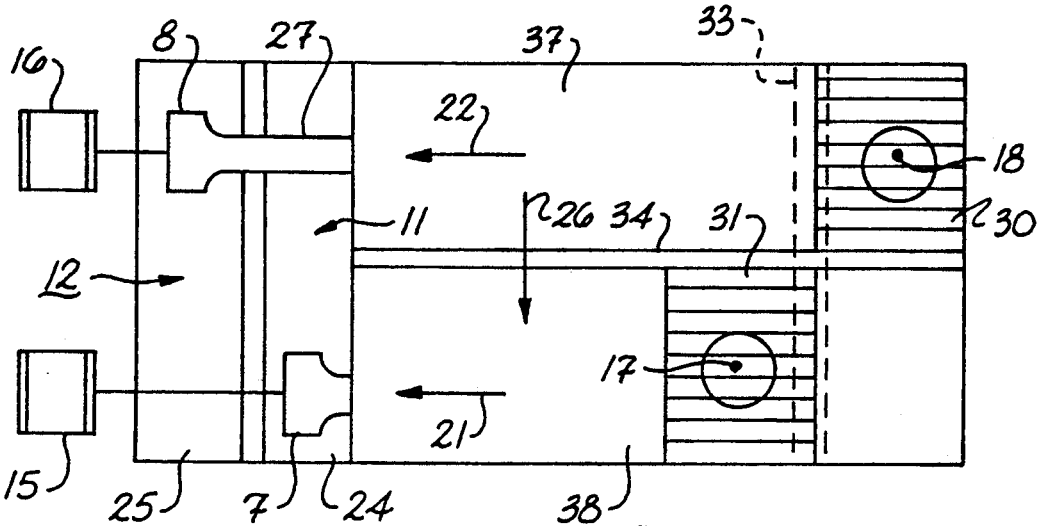
FIG. 2 is a bottom plan view, in horizontal section, of the textile drying machine shown in FIG. 1 as taken along line II—II thereof.
Figure 3:
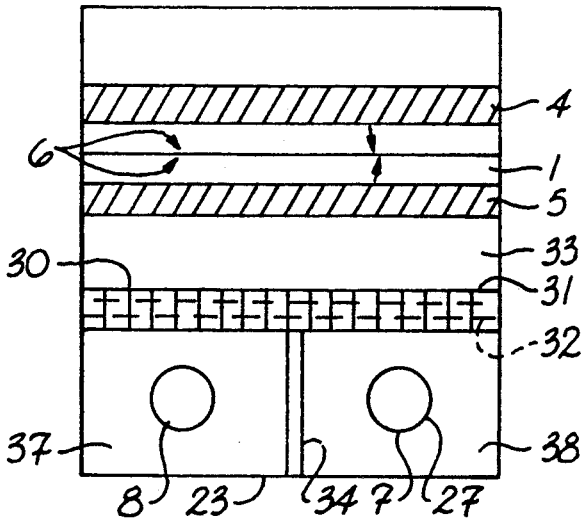
FIG. 3 is a front elevational view, in vertical section, of the textile drying machine shown in FIG. 1 as taken along line III—III.

In FIGS. 1-3, the preferred embodiment of the textile drying machine of the present invention is illustrated. The textile drying machine which can be, for example, a tenter frame, is operable to apply drying fluid to a web of textile material 1 continuously traveling therethrough. The drying fluid can be, for example, heated air, which is continuously applied to the web 1 as it travels from an entrance end to an exit end of the textile drying machine.

As seen in FIG. 1, the textile drying machine includes a pair of conventional web advancing assemblies 2,3, each comprising an endless belt having a plurality of uniformly spaced upright pins therealong with each endless belt being driven through a horizontal top run in which the uniformly spaced pins project upwardly for engaging the edge (or selvedge) of the traveling web on a respective lateral side thereof. The web advancing assemblies 2,3 thus advance the web 1 along a horizontal travel path with the web being maintained in a horizontal planar orientation throughout its travel through the textile drying machine in a transport direction indicated by the arrow 26 in FIG. 2.

The textile drying machine also includes a far side or overhead treatment means having a plurality of upper jet nozzles (not shown) each for applying a stream of drying fluid onto the web from a position above the web and a far side or upper distribution housing 25 for supporting the plurality of upper jet nozzles. The textile drying machine further includes an underneath treatment means having a plurality of lower jet nozzles (not shown) each for jetting a stream of drying fluid onto the web 1 from a position below the web and a rear side or lower distribution housing 24 in which the lower jet nozzles are supported.

The upper distribution housing 25 includes a base or lower portion extending from a location on the floor 23 (e.g., a location lower than the travel path of the web 1) on one lateral side of the web 1 to an above the web distribution portion 14 disposed higher than the travel path of the web 1 and extending laterally across the width of the web 1. The above the web distribution portion 14 includes a roof section 4 and a plurality of wall sections extending downwardly from the roof section 4 toward the web 1.

The lower distribution housing 24 of the underneath treatment means includes a base or lower portion extending from a location on the floor 23 (e.g., lower than the travel path of the web 1) on the same respective lateral side of the web as the lower portion of the upper distribution housing 25. The lower portion of the lower distribution housing 24 is positioned laterally inwardly of the lower portion of the upper distribution housing 25 and extends to a below the web distribution portion 12 which extends laterally across the web 1 therebelow. The below the web distribution portion 13 includes a floor section 5 and a plurality of wall sections extending upwardly from the floor section 5 toward the web 1 thereabove.

The textile drying machine further includes a first intake means for the intake of drying fluid into the lower distribution housing 2 after the drying fluid has contacted the web 1 (hereinafter referred to as exhaust drying fluid). The first intake means includes a first intake conduit 7 having a fan blade rotatably supported therein. The first intake conduit 7 has a laterally facing intake opening which opens into an open area below the floor section 5 of the lower distribution housing 24. The fan blade rotatably supported in the first intake conduit 7 is fixedly mounted to the free end of the shaft of a conventional fan drive motor 15, as shown in FIG. 2 for driving rotation of the fan blade (not shown) to effect the intake of exhaust drying fluid into the intake opening of the first intake conduit 7 and to propel the drawn in exhaust drying fluid upwardly from the first intake conduit 7 in the direction indicated by the arrow 9 in FIG. 1 into the below the web distribution portion 13.

A second intake means is provided for the intake of exhaust drying fluid into the upper distribution housing 25 after the drying fluid has contacted the web 1. The second intake means includes a second intake conduit 8 having a fan blade (not shown) rotatably supported therein. As seen in FIG. 2, the fan blade is fixedly mounted to the free end of the shaft of a conventional fan drive motor 16 operable to drive the fan blade to effect the drawing in of exhaust drying fluid into the second intake conduit 8. As best seen in FIGS. 2 and 3, the second intake conduit 8 is offset from the first intake conduit 7 relative to the transport direction 26 and, as seen in FIG. 2, the second intake conduit 8 has a fan blade portion disposed in the lower portion of the upper distribution housing 25 and a lateral extension portion 27 extending from the fan blade portion laterally inwardly through the lower portion of the lower distribution housing 24 to a second laterally facing intake opening, as seen in FIG. 3. As seen in FIG. 3, the first intake opening of the first intake conduit 7 and the second intake opening of the second intake conduit 8 are disposed at generally the same height above the floor 23 and are generally laterally aligned with one another.

The roof section 4 of the upper distribution housing 25 is provided with an upper mounted exhaust outlet for the passage therethrough of exhaust drying fluid drawn upwardly into the above the web distribution portion 23 of the upper distribution housing 25. A lower mounted exhaust outlet is formed in the floor portion 5 of the lower distribution housing 24 for the passage therethrough of exhaust drying fluid drawn downwardly into the below the web distribution portion 13 of the lower distribution housing 24.

The textile drying machine also includes heat exchanger means 20 comprising, as seen in FIGS. 1 and 2, a first heat exchanger assembly 31 associated with the lower distribution housing 24 and a second heat exchanger assembly 30 associated with the upper distribution housing 25. The dividing wall 33 includes a lateral component which extends from a location laterally outward of the other lateral side of the web toward the lower distribution housing 24 below its floor section 5 at a location intermediate the entrance and exit ends of the textile drying machine relative to the transport direction 26 and a longitudinal component, seen in FIG. 1, which extends from the lateral component below the floor section 5 parallel to the transport direction 26. The longitudinal and lateral components of the dividing wall 33 divide the exhaust zone 19 in which exhaust drying fluid exits the lower distribution housing 24 and the upper distribution housing 25 into a first exhaust area 29 in which exhaust drying fluid (indicated by the arrow 17 in FIG. 1) passing through the lower mounted exhaust outlet in the floor section 5 is constrained to flow through the first heat exchanger assembly 31 for a heat exchange operation in which the heat content of the exhaust drying fluid is increased and a second exhaust drying fluid region 28 in which exhaust drying fluid (indicated by the arrow 18 in FIG. 1 and FIG. 3) passing through the upper mounted exhaust outlet are constrained to flow through the second heat exchanger assembly 30 for a heat exchange operation in which the heat content of the exhaust drying fluid is increased. A horizontal channeling panel 32 extends from the lower portion of the lower distribution housing 24 laterally to the heat exchanger means 20 for channeling exhaust drying fluid exiting the exhaust outlets to the heat exchanger assemblies 30,31.

The textile drying machine operates as follows to dry the web 1 traveling therethrough. The web advancing assemblies 2,3 continuously advance the web 1 through movement of their respective endless belts while maintaining the web 1 in a planar horizontal orientation as the web 1 travels between the upper distribution housing 25 and the lower distribution housing 24. The upper and lower jet nozzles apply streams of drying fluid in the directions indicated by the arrow 6 in FIG. 1 to the web from above and below the web to effect thermal drying of the web. At the same time, drying fluid which has already contacted the web 1 and which is below the web is drawn by the action of the fan blade in the first intake conduit 7 sequentially through the lower mounted exhaust outlet along paths indicated by the arrows 17, to the first heat exchanger 31 for restoring the heat content of the drying fluid and thereafter along paths indicated by the arrows 21 in FIG. 1 into the first intake opening 7. The drying fluid drawn into the first intake conduit 7, its heat content having been restored by the first heat exchanger 31, is then propelled in the direction indicated by the arrow 9 in FIG. 1 from the lower portion of the lower distribution housing 24 into the below the web distribution portion at which the lower jet nozzles apply the recirculated drying fluid onto the web 1.

Drying fluid which has contacted the web 1 and is above the web is drawn by the action of the fan blade in the second intake conduit 8 sequentially through the upper mounted exhaust outlet and along paths indicated by the arrows 18 to the second heat exchanger assembly 30 for a heat exchange operation in which the heat content of the drying fluid is restored. Thereafter, the drying fluid is drawn along paths indicated by the arrows 22 in FIG. 1 to the second intake conduit 8 and propelled by the fan blade in the second intake conduit in the direction indicated by the arrow 10 in FIG. 1 from the lower portion of the upper distribution housing 25 to the above the web distribution 1 for re-application to the web 1.

The textile drying machine of the present invention thereafter advantageously provides a space saving arrangement in which both the lower distribution housing 24 and the upper distribution housing 25 are mounted on the floor 23 on the same lateral side of the travel path of the web 1 with the respective distribution openings of the distribution housings each extending adjacent the entire extent of the respective lengthwise portion o the web 1 traveling through the textile drying machine. Although the extension portion 27 of the second intake conduit 8 extends through the lower distribution housing 24, the extension portion is of such relatively small area as compared to the total area of the lower portion of the lower distribution housing 24 through which it passes that it does not significantly impact the flow characteristic of drying fluid being distributed by the lower distribution housing 24. Moreover, the region 19 in which drying fluid is exhausted from the distribution housings is advantageously subdivided into two exhaust regions 28,29 separate from one another so that the drying fluid exhausted from one distribution housing is recirculated to only that same distribution housing. This divided arrangement permits independent regulation of the operational parameters of each distribution housing such as, for example, individual regulation of pressure and temperature parameters.

With further reference to the arrangement of the textile drying machine for separately guiding exhaust drying fluid exiting the lower distribution housing 24 to the first heat exchanger assembly 31 and the exhaust drying fluid exiting the upper distribution housing 25 is guided to the second heat exchanger assembly 30, it can be seen in FIG. 2 that the lateral component is in the form of a horizontal channeling panel 32 which extends from the lower distribution housing 24 to the first heat exchanger assembly 31 and to the second heat exchanger assembly 30. The longitudinal component, seen in FIG. 1, is in the form of a vertical divider 34 extending from the lower distribution housing 24 at a location intermediate the intake conduits 7,8 relative to the transport direction 26 to the outward lateral edge of the second heat exchanger assembly 30 transversely to the transport direction 26. The vertical dividing wall 36 extends vertically from the floor 23 to the bottom surface of the planar horizontal divider 32 and to the undersides of the first heat exchanger assembly 31 and the second heat exchanger assembly 32. Additionally, the dividing wall 33 includes a second vertical divider extending in the transport direction 26 from the level of the heat exchanger assemblies 30,31 to the underside of the lower distribution housing 24 below its floor section 5. The inward lateral edge of the second heat exchanger assembly 30 is in abutment with the second vertical divider 33 and the outward lateral side of the first heat exchanger assembly 31 is in abutment with the second vertical divider as well.

As seen in FIG. 1, the horizontal channeling panel 32, the heat exchanger assemblies 30,31 and the second vertical divider of the dividing wall 33 separate the exhaust areas 28,29 into an upper region 35 and a lower region 36. The exhaust drying fluid exiting the upper distribution housing 25 is prevented by the second vertical divider of the dividing wall 33 from mixing from the exhaust drying fluid exiting the lower distribution housing 24 within the upper region 35. Accordingly, the exhaust drying fluid exiting the upper distribution housing 25 is constrained to flow downwardly through the second heat exchanger assembly 30 into the lower region 36 wherein the first vertical divider 34 prevents the exhaust drying fluid which has flowed through the the second heat exchanger assembly 30 from mixing from the exhaust drying fluid which has flowed through the first heat exchanger assembly 31. The exhaust drying fluid which has flowed through the second heat exchanger assembly 30 is thereby constrained to flow, in a direction indicated by the arrow 22 in FIG. 2, into the second intake conduit 8, in a portion 37 of the lower region 36.

The exhaust drying fluid exiting the lower distribution housing 34 is prevented by the second vertical divider of the dividing wall 33 from mixing with the exhaust drying fluid exiting the upper distribution housing 24. Additionally, the planar horizontal channeling panel 32 and the second vertical divider 33 cooperate to guide the exhaust drying fluid exiting the lower distribution housing 24 to flow through the first heat exchanger assembly 31, in a direction indicated by the arrow 21 in FIG. 2, into a portion 38 of the lower region 36 wherein the exhaust drying fluid is guided to the first intake conduit 7.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A textile drying machine for applying a drying fluid to a traveling web of textile material, comprising:

means for advancing a web of textile material along a generally planar travel path;

lower side treatment means including lower side jet nozzle means for jetting drying fluid onto the web from a lower side thereof relative to a transverse axis transverse to the plane of the travel path and a lower side housing, the lower side housing having a base portion and a distribution portion extending from the base portion in which the lower side jet nozzle means is mounted;

upper side treatment means including upper side jet nozzle means for jetting drying fluid onto the web from the upper side of the web opposite to the lower side thereof and an upper side housing, the upper side housing including a base portion and a distribution portion extending from the base portion in which the upper side jet nozzle means is mounted, the base portion of the upper side housing extending from the upper side of the web to the lower side of the web on one lateral side of the web relative to a lateral direction transverse to the travel path and being laterally outward of the base portion of the lower side housing and the base portions of the lower side housing and the upper side housing being substantially coextensive with one another relative to the travel path;

a lower side exhaust outlet formed in the lower side housing for passage therethrough of exhaust drying fluid being drawn away from the web;

an upper side exhaust outlet formed in the upper side housing for passage therethrough of exhaust drying fluid being drawn away from the web;

first intake means for the intake of exhaust drying fluid, the first intake means including a first intake conduit extending into the base portion of the lower side treatment means and suction means for drawing exhaust drying fluid into the first intake conduit; and second intake means for the intake of exhaust drying fluid, the second intake means including a second intake conduit extending laterally completely through the base portion of the lower side housing and into the base portion of the upper side housing and suction means for drawing drying fluid into the second intake conduit.

2. A textile drying machine according to claim 1 and further comprising a first heat exchanger means disposed intermediate the lower side exhaust outlet and the first intake conduit relative to the flow of drying fluid therebetween for performing a heat exchange operation on drying fluid after its passage through the lower side exhaust outlet and before its intake into the first intake conduit and a second heat exchanger means disposed intermediate the upper side exhaust outlet and the second intake conduit relative to the flow of drying fluid therebetween for performing a heat exchange operation on drying fluid after its passage through the upper side exhaust outlet and before its intake into the second intake conduit.

3. A textile drying machine according to claim 1 wherein the first and second intake conduits are disposed at generally the same transverse spacing from the plane of the path of the traveling web.

4. A textile drying machine according to claim 2 and further comprising first flow path defining means extending from the distribution portion of the lower side housing and forming therewith a first flow path in which the first heat exchanger means is disposed, whereby the drying fluid passing through the lower side exhaust outlet is constrained to flow along the first flow path through the first heat exchanger means and thereafter into the first intake conduit.

5. A textile drying machine according to claim 2 and further comprising second flow path defining means extending from the distribution portion of the upper side housing and forming therewith a second flow path in which the second heat exchanger means is disposed whereby the drying fluid passing through the upper side exhaust outlet is constrained to flow through the second heat exchanger means and into the second intake conduit.

6. A textile drying machine according to claim 2 and further comprising first flow path defining means extending from the distribution portion of the lower side housing and forming therewith a first flow path in which the first heat exchanger means is disposed and second flow path defining means extending from the distribution portion of the upper side housing and forming therewith a second flow path in which the second heat exchanger means is disposed, whereby drying fluid passing through the lower side exhaust outlet is constrained to flow along the first flow path through the first heat exchanger means and thereafter into the first intake conduit and drying fluid passing through the upper side exhaust outlet is constrained to flow through the second heat exchanger means and thereafter into the second intake conduit.

7. A textile drying machine according to claim 1 wherein the first intake conduit is communicated with the distribution portion of the lower side housing and the second intake conduit is communicated with the distribution portion of the upper side housing, whereby drying fluid flows through the first intake conduit to the distribution portion of the lower side housing for the application of the drying fluid onto the web by the lower side jet nozzle means and drying fluid flows through the second intake conduit to the distribution portion of the upper side housing for the application of the drying fluid onto the web by the upper side jet nozzle means.

8. A textile drying machine for applying a drying fluid to a traveling web of textile material, comprising:

means for advancing a web of textile material along a generally planar travel path;

lower side treatment means including lower side jet nozzle means for jetting drying fluid onto the web from a lower side thereof relative to a transverse axis transverse to the plane of the travel path of the web and a lower side housing, the lower side housing having a base portion and a distribution portion extending from the base portion in which the lower side jet nozzle means is mounted;

upper side treatment means including upper side jet nozzle means for jetting drying fluid onto the web from the upper side thereof opposite to the lower side thereof, and an upper side housing, the upper side housing including a base portion and a distribution portion extending from the base portion in which the upper side jet nozzle means is mounted, the base portion of the upper side housing extending from above the upper side of the web to a location below the lower side of the web on one lateral side of the web and being laterally outward of the base portion of the lower side housing and the base portion of the lower side housing and the upper side housing being substantially co-extensive with one another relative to the travel path;

a lower side exhaust outlet formed in the lower side housing for passage therethrough of exhaust drying fluid being drawn away from the web;

an upper side exhaust outlet formed in the upper side housing for passage therethrough of exhaust drying fluid being drawn away from the web;

first intake means for the intake of exhaust drying fluid, the first intake means including a first intake conduit extending into the base portion of the lower side treatment means and suction means for drawing exhaust drying fluid into the first intake conduit;

first segregated return path means for constraining exhaust drying fluid passed through the lower side exhaust outlet to flow in a first segregated flow path from the lower side exhaust outlet to the first intake conduit;

second intake means for the intake of exhaust drying fluid, the second intake means including a second intake conduit extending laterally completely through the base portion of the lower side housing and into the base portion of the upper side housing, and suction means for drawing exhaust drying fluid into the second intake conduit; and second segregated return path means for constraining exhaust drying fluid passed through the upper side exhaust outlet to flow in a second segregated flow path from the upper side exhaust outlet to the second intake conduit, the first and second segregated flow paths being completely separate from one another such that exhaust drying fluid drawn away from the web through the lower side exhaust outlet is only supplied to the lower side distribution housing and exhaust drying fluid drawn away from the web through the upper side exhaust outlet is only supplied to the upper side distribution housing.

* * * * *